US007424864B2

(12) United States Patent
McCann

(10) Patent No.: US 7,424,864 B2
(45) Date of Patent: Sep. 16, 2008

(54) FLAG AND FLAG KIT

(75) Inventor: Christopher Paul McCann, Glenwood (ZA)

(73) Assignee: Sunsmart Products (Pty) Limited (ZA)

( * ) Notice: Subject to any disclaimer, the term of this patent is extended or adjusted under 35 U.S.C. 154(b) by 0 days.

(21) Appl. No.: 10/554,955

(22) PCT Filed: Apr. 29, 2004

(86) PCT No.: PCT/ZA2004/000045

§ 371 (c)(1),
(2), (4) Date: May 11, 2006

(87) PCT Pub. No.: WO2004/097118

PCT Pub. Date: Nov. 11, 2004

(65) Prior Publication Data

US 2006/0249069 A1 Nov. 9, 2006

(30) Foreign Application Priority Data

Apr. 30, 2003 (ZA) ..... 03/3380

(51) Int. Cl.
*G09F 17/00* (2006.01)

(52) U.S. Cl. ..... 116/174; 40/603; 116/173

(58) Field of Classification Search ..... 116/173–175; 40/602–604, 610; 73/170.01, 170.05; D20/10, D20/21, 42; D11/165, 166, 181, 182
See application file for complete search history.

(56) References Cited

U.S. PATENT DOCUMENTS 1,194,610 A * 8/1916 Fischer ..... 40/603
1,253,380 A * 1/1918 Hoffman ..... 116/174
1,283,136 A * 10/1918 Foulkes ..... 116/174
1,339,849 A * 5/1920 Johnson et al. ..... 116/174
1,396,787 A * 11/1921 Shepard ..... 116/173
1,448,299 A * 3/1923 Holliday ..... 116/174
1,453,772 A * 5/1923 Trachtenberg ..... 116/173
1,476,426 A * 12/1923 Short ..... 116/174
1,646,467 A * 10/1927 Walton ..... 116/174
2,005,134 A * 6/1935 Emley ..... 40/603
2,072,573 A * 3/1937 Vigliotti ..... 116/173
2,302,524 A * 11/1942 Borregard ..... 116/173
2,732,823 A 1/1956 Hanson
3,088,235 A * 5/1963 Kies ..... 40/477
3,091,215 A 5/1963 Kenmore
3,591,940 A * 7/1971 Slemmons ..... 40/603
3,595,202 A 7/1971 Visitacion
4,024,833 A * 5/1977 Pook et al. ..... 116/173

(Continued)

*Primary Examiner*—R. A. Smith
*Assistant Examiner*—Amy Cohen Johnson
(74) *Attorney, Agent, or Firm*—Neil F. Markva

(57) ABSTRACT

This invention provides a flag (1), consisting of a flexible membrane (2), a shaft (3) and a distending mechanism comprising resilient rods (4.1) and (4.2). The shaft (3) is hollow and forms a sleeve about a flag staff (7). The flexible membrane (2) has a leading end (5) and a trailing end (6). The leading end (5) is removably attached to the shaft or sleeve (3). Each rod (4.1) and (4.2) has a fixing end and a free end. The fixing ends are frictionally fixed to the sleeve (3) by a collar (8) located on the sleeve, and the free ends are retained in pockets (6.1) and (6.2) provided in the trailing end (6). In use, the rods (4.1) and (4.2) exerts a pressure from within the membrane (2), resulting in the distended state of the flag (1) under all weather conditions.

9 Claims, 6 Drawing Sheets

U.S. PATENT DOCUMENTS 4,558,862 A * 12/1985 Kelly ..... 473/176
4,603,652 A 8/1986 Thibault et al.
5,609,122 A * 3/1997 Jimmie ..... 116/173
5,694,733 A * 12/1997 Gallemore, II ..... 52/736.2
5,884,578 A 3/1999 Thostrup et al.
5,924,669 A * 7/1999 Richins ..... 248/513
6,530,338 B2 * 3/2003 Okumura et al. ..... 116/173
6,584,928 B2 * 7/2003 Kinahan ..... 116/174
6,758,003 B2 * 7/2004 Zheng ..... 40/610
6,845,730 B2 * 1/2005 Cardarelli ..... 116/173
6,923,141 B1 * 8/2005 Staats et al. ..... 116/173
7,213,355 B2 * 5/2007 Aires ..... 40/604
2005/0263061 A1 * 12/2005 Llewellyn ..... 116/174

* cited by examiner

FLAG AND FLAG KIT

RELATED APPLICATIONS

This is a U.S. non-provisional application for which priority is claimed and based on International Application No. PCT/ZA 2004/000045 filed Apr. 29, 2004 having priority based on Application No. 03/3380 filed Apr. 30, 2003 in South Africa.

BACKGROUND TO THE INVENTION

This invention relates to a flag and to a flag kit.

The nouns "flag" and "banner" are accorded the same meaning and are used inter-changeably hereinafter.

The display of flags enjoys universal popularity. Flags had been typically nationalistic flags, such as the South African flag. However, "decorative" flags have become popular in recent years for displaying information, more specifically in the advertising industry. Flags have also become popular as wind direction indicators, such as for example, flags used on golf courses that show golfers wind direction to enable the golfer to compensate for particular wind conditions before playing the shot. These wind direction indicators have also become popular in recent years for displaying information printed thereon.

Out of doors, and at the mercy of vagaries of the wind, flags have a tendency to wind around their staff, which results in a somewhat sorry sight, contrary to the desired effect. The flags do not float in the wind, or are partially hampered, in a period of calm. The sight remains just as unsatisfactory, if not more so, if no one unfurls the flags.

Flags of the kind relevant to the invention described in the present specification are known inter alia from U.S. Pat. Nos. 2,732,823 and 3,091,215, and these flags are provided with a pocket extending diagonally from the lower corner adjacent the staff to the upper corner farthest away from said staff. A reinforcing rib is placed in the pocket. These arrangements are primarily adapted to be used in connection with strong plastic traffic flags. Problems arise, however, when these arrangements are used for flags of conventional fabric because such flags are not kept distended so as to present a natural appearance and information displayed thereon cannot be read easily.

U.S. Pat. No. 5,884,578 describes a flag that comprises a resilient bar being retained in pockets in the upper rim of the flag and the rim of said flag adjacent the staff, respectively. The bar is firmly fixed and extends substantially in the entire plane of the flag so that between its ends it forms a curve extending upwards towards the upper corner of the flag.

The applicant is aware of arrangements in which the flag hangs loosely downwards from a horizontally projecting bar arranged perpendicular to the staff. This flag, however, cannot be kept distended either so as to present a natural appearance.

U.S. Pat. No. 3,595,202 describes fixing the flag to the staff via at least one sleeve coaxial to the staff mounted to rotate freely thereon, the sleeve having a pair of spaced apart discs on its upper portion and on its lower portion and a rotating ring located between the pair of spaced apart discs. Each rotating ring is provided with an arm radially extending therefrom, and a bar being attached to the arms so that the flag may be easily hooked on the bar. Thus, under the effect of the wind and/or the weight of the flag, the flag exerts on the sleeve a rotating torque tending to rotate it and avoid the flag winding therearound.

U.S. Pat. No. 4,603,652 describes a device for fastening a flag on a staff via a sleeve coaxial to the staff mounted to rotate freely on the staff. The device comprises a rod having two ends. The first end is connected to the sleeve so that the rod extends, at least partially, in a plane substantially transverse to the sleeve. The second end of the rod is remote from the sleeve and connected to the flag. The result is that the torque exerted by the flag on the sleeve under the effect of the wind and/or the weight of the flag is increased.

Although the known devices have, in principle, brought some improvements, to the applicant's knowledge, they have not been developed commercially, doubtless due to their relatively complex construction and their inadequacies in use.

The majority of flags known to the applicant are not durable as such flags have a tendency to flutter under windy conditions resulting in the flags tearing.

The object of this invention is to provide a flag that rotates freely on a staff whilst being kept fully distended under all wind and weather conditions. The flag according to the invention provides increased visibility and durability of the flag thereby meeting the demands from the advertising industry.

SUMMARY OF THE INVENTION

According to this invention there is provided a flag consisting of a flexible membrane attached to a shaft adapted to rotate about an axis in alignment with the axis of the staff of the flag, the membrane being adapted to be held distended normal to the staff and across the plane of the membrane.

In one version of the invention, the axis of rotation is congruent with the axis of the staff.

In another version of the invention, the axis of rotation is parallel to and remote from the axis of the staff.

The shaft is preferably in the form of a sleeve.

The flexible membrane may be held distended by means applying pressure from within the membrane.

The flexible membrane may be removably attached to the shaft.

The flexible membrane may be a textile, fabric or plastic material.

The distending means may be integral with the shaft.

The distending means may be removably fixed to the shaft.

The distending means may be pocketed within the membrane.

According to another aspect of the invention, there is provided a flag kit consisting of a flexible membrane having means for removable attachment of the membrane to a shaft adapted to rotate about an axis in alignment with the axis of a flag staff in use, the membrane being adapted to be held distended normal to the staff of the flag and across the plane of the membrane by means applying pressure from within the membrane and the shaft being provided with means for fixation of the distending means to the shaft in use.

The flexible membrane may be a textile, fabric or plastic material.

The means for removable attachment of the flexible membrane to the shaft may comprise a hook and loop fastener or the like.

In another embodiment of the invention, the attachment means comprises a pocket formed by a seam provided along at least a portion of the leading end of the membrane within which the shaft is located in use.

The means for removable fixation of the distending means to the shaft may comprise a collar, clamp, binder, or any other suitable fastening means.

The distending means may be pocketed within the membrane.

Still further according to the invention, the membrane itself, for use with the flag or banner of the invention, falls within the scope of the invention.

BRIEF DESCRIPTION OF THE DRAWINGS

Further features of a flag and flag kit in accordance with the invention are described by way of non-limiting examples of the invention, with reference to and as illustrated in the accompanying diagrammatic drawings.

In the drawings.

DESCRIPTION OF EMBODIMENTS OF THE INVENTION

Figure 1:
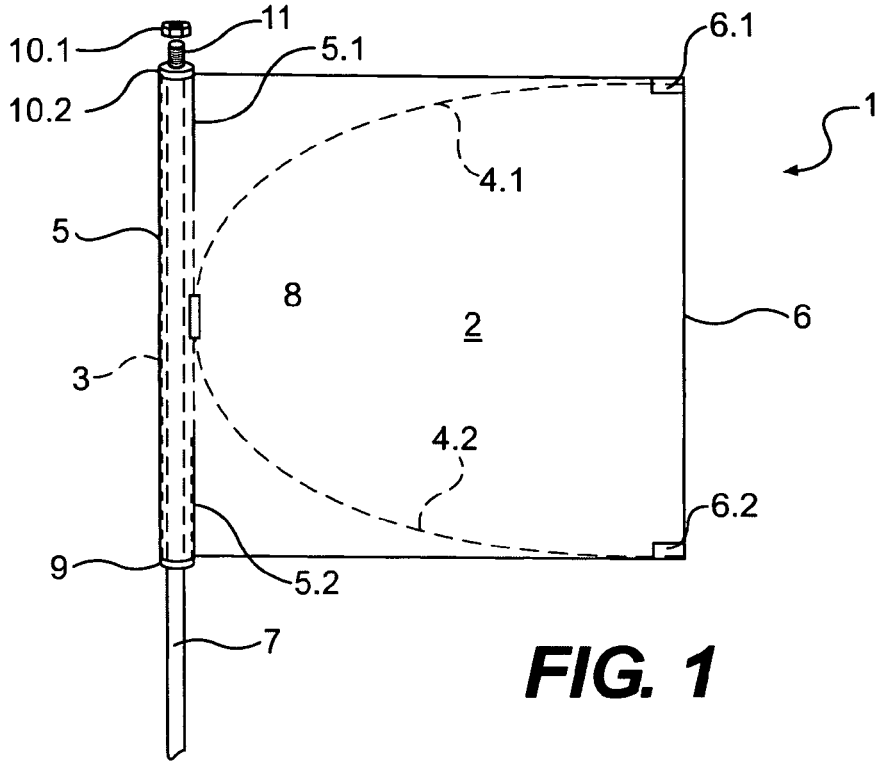
FIG. 1 shows a side view of a flag in accordance with one embodiment of the invention.
Figure 2:
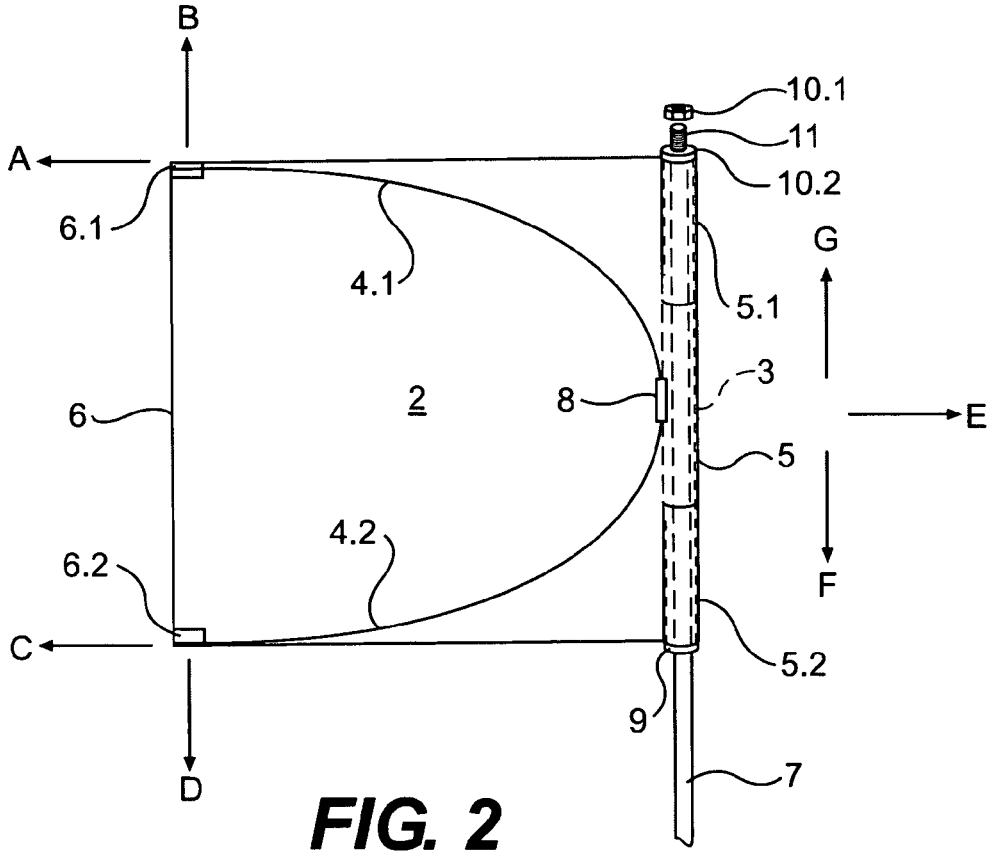
FIG. 2 is a rear view of the flag of FIG. 1.

With reference to FIG. 1 and FIG. 2 and as evident in the drawings, a flag in accordance with the invention, is designated generally by the reference numeral 1. The flag 1 consists of a flexible membrane 2, sleeve member 3 having two outer ends, and distending means comprising resilient or flexible rods 4.1 and 4.2. In the description of the embodiments which follow the adjective "distending" is used in its grammatical sense of applying pressure from within the parameters of the membrane 2.

The flexible membrane 2 is a textile material. In another form of the invention, the flexible membrane is a fabric material. In a further form, the flexible membrane is a plastic material.

The membrane 2 has a leading end 5 and a trailing end 6. The leading end 5 is provided with tubes formed by a seam 5.1 along an upper portion thereof and a seam 5.2 along a lower portion thereof. The trailing end 6 is provided with a pocket 6.1 along a top corner thereof and a pocket 6.2 along a bottom corner thereof.

Hollow sleeve member 3 is disposed about a flag staff 7 with the axis of the sleeve member 3 thus being congruent with the axis of flag staff 7and, when in use, is able to rotate freely on staff 7. The leading end 5 is removably attached to sleeve member 3, which is accommodated in the tubes formed by seams 5.1 and 5.2.

In a preferred form of the invention and as evident in the drawings, the leading end 5 is removably attached to sleeve member 3 by means of a hook and loop fastener such as VELCRO or the like provided along at least a portion of the leading end 5 on each side of the collar or lug 8. This facilitates the removal and replacement of the membrane on which information is displayed to allow changes to the information displayed on the membrane.

Sleeve member 3 may be made of plastic, steel, aluminum, PVC or the like.

The distending means comprises two resilient or flexible rods 4.1 and 4.2. As evident in the drawings, each rod 4. 1 and 4.2 has a fixing end and a free outer distal end. The fixing ends are frictionally fixed to sleeve member 3 by means of a collar or lug 8 located on sleeve member 3 so that rods 4.1 and 4.2 are held integral with sleeve member 3. The free ends of rods 4.1 and 4.2 are retained in pockets 6.1 and 6.2, respectively.

Means alternative to a collar for fixation of rods 4.1 and 4.2 to the sleeve member 3 may include a clamp, binder or any other suitable fastening means.

In use, the free end of rod 4.1 exerts an outward pressure along the top of membrane 2 as illustrated by arrow A in the drawing, as well as an upward pressure, as is illustrated by arrow B. The free end of rod 4.2 exerts an outward pressure along the bottom of membrane 2 as illustrated by arrow C in the drawing, as well as an downward pressure, as illustrated by arrow D. The fixing end of rod 4.1 exerts a backward pressure along the leading end thereof as illustrated by arrow E in the drawing, as well as a downward pressure as illustrated by arrow F. The fixing end of rod 4.2 exerts a backward pressure along the leading end thereof as illustrated by arrow B in the drawing, as well as an upward pressure as illustrated by arrow G.

The distending means, consisting of rods 4.1 and 4.2, thus exerts a pressure from within membrane 2 resulting in the distended state of the flag 1 under all weather conditions. Rods 4.1 and 4.2 are composed of a suitable resilient material such as, for example, steel, glass fibre, carbon reinforced material, PVC or the like.

Flag staff 7 is provided with retaining means in the form of a stop 9, along the length of staff 7 and, at the top of staff 7, a nut 10.1 turned onto a threaded length 11 via washer 10. 2. Accordingly, the flag can easily be removed from staff 7 in use and replaced to suit desired changes in the information to be displayed on the flag. Retaining means alternative to nut 10.1 may include a plug, cap, circlip or the like.

In use, flag 1 is rotatably mounted on staff 7 by sliding sleeve member 3 onto staff 7 until flag 1 is brought to rest on staff 7 by means of the stop 9. The flag 1 is then retained on staff 7 by means of nut 10.1. When flag 1 is no longer required or is to be replaced by another flag, nut 10.1 is simply unfastened to release sleeve member 3, and hence flag 1, from staff 7.

To assemble flag 1, sleeve member 3 is inserted into the tubes formed by seams 5.1 and 5.2. Rods 4.1 and 4. 2 are then fixed integrally to sleeve member 3 by inserting the fixing ends of the rods to friction fit in collar or lug 8. The free ends of rods 4.1 and 4.2 are then retained in pockets 6.1 and 6.2, respectively. To disassemble flag 1, the steps of assembly are simply reversed.

Figure 3:
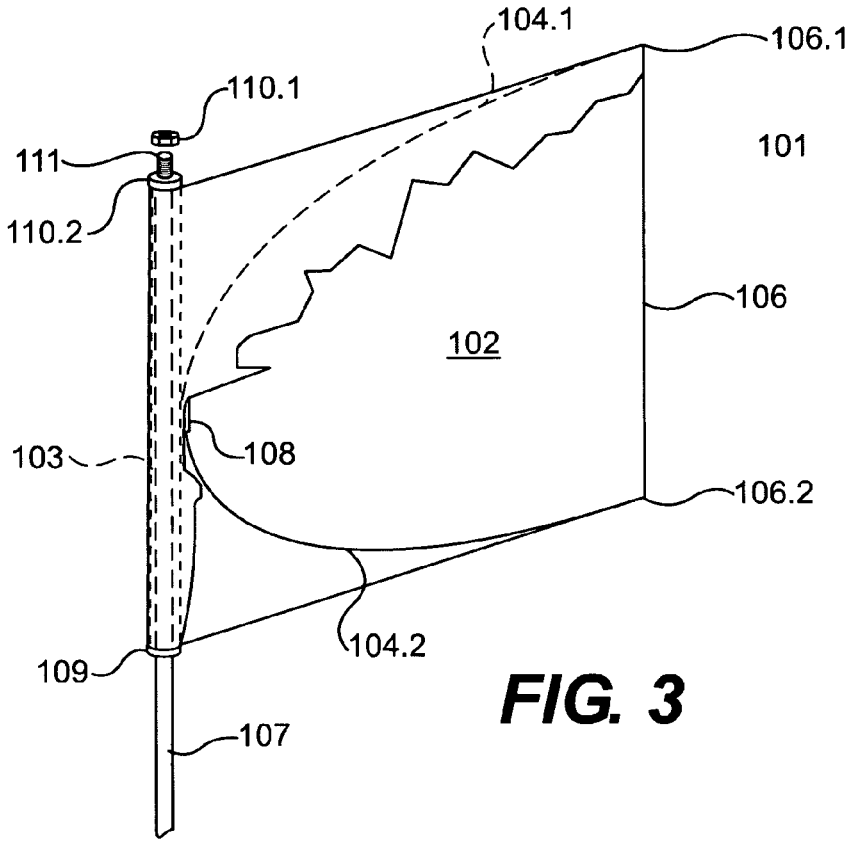
FIG. 3 is a partially cut away pictorial view of another embodiment of the invention.
Figure 4:
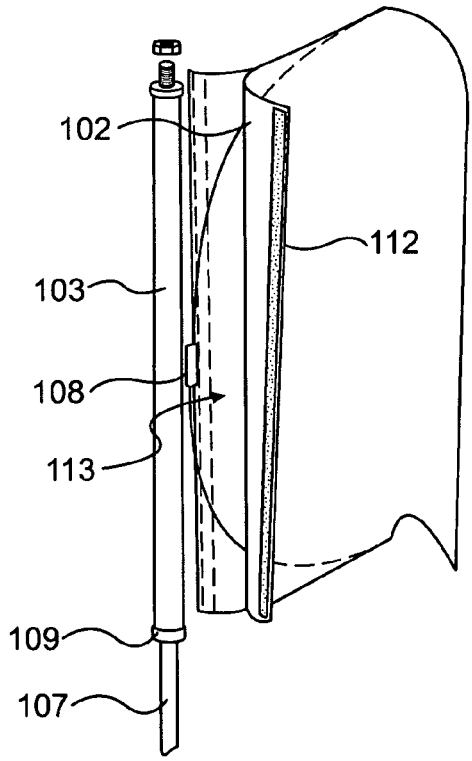
FIG. 4 a pictorial view illustrating the manner in which the membrane is attached to the sleeve of the flag of FIG. 3.

With reference to FIG. 3 and FIG. 4 of the drawings, another embodiment of a flag in accordance with the invention is designated generally by the reference numeral 101 and like reference numerals refer to like components.

Flag 101 is very similar to flag 1 of FIGS. 1 and 2, with a difference being that the membrane is an envelope 102 within which rods 104. 1 and 104.2 and sleeve member 103 are encapsulated. The free ends of rods 104.1 and 104.2 are respectively retained in the upper corner 106.1 and lower corner 106.2 of a closed end constituted by trailing end 106 of envelope 102. Envelope 102 is provided with VELCRO 112 along its opening 113. The advantage of the construction of flag 101 is that information can be displayed on both surfaces of the flag.

Furthermore, when a user wishes only to replace the information displayed on flag 101, the VELCRO 112 is unfastened and envelope 102 is removed by pulling it off rods 104.1 and 104.2. This is particularly advantageous in the advertising industry as information displayed on the flag can be replaced as required by the user.

To assemble flag 101, the distending means, in the form of rods 104.1 and 104.2, is attached to sleeve member 103 by fixing the rods firmly in place in collar or lug 108. The free ends of rods 104.1 and 104.2 are then urged towards each other and envelope 102 is pulled by its open end, as illustrated in FIG. 4 of the drawings, until rods 104.1 and 104.2 and the sleeve member 103 are encapsulated within envelope 102. Fastening the VELCRO 112 then closes the opening of envelope 102. Sleeve member 103 is then slid onto staff 107 until it is brought to rest by stop 109, and member sleeve 103 is then retained on staff 107 by partially tightening nut 110.1 on the threaded portion 111 via washer 110.2.

To disassemble flag 101, nut 110.1 and then sleeve member 103 are removed from staff 107. The VELCRO 112 is then unfastened to open envelope 102, which is then removed by pulling it off rods 104.1 and 104.2. Rods 104.1 and 104.2 are then removed from collar or lug 108 and the components of the resultant kit can then be stored away.

Figure 5:
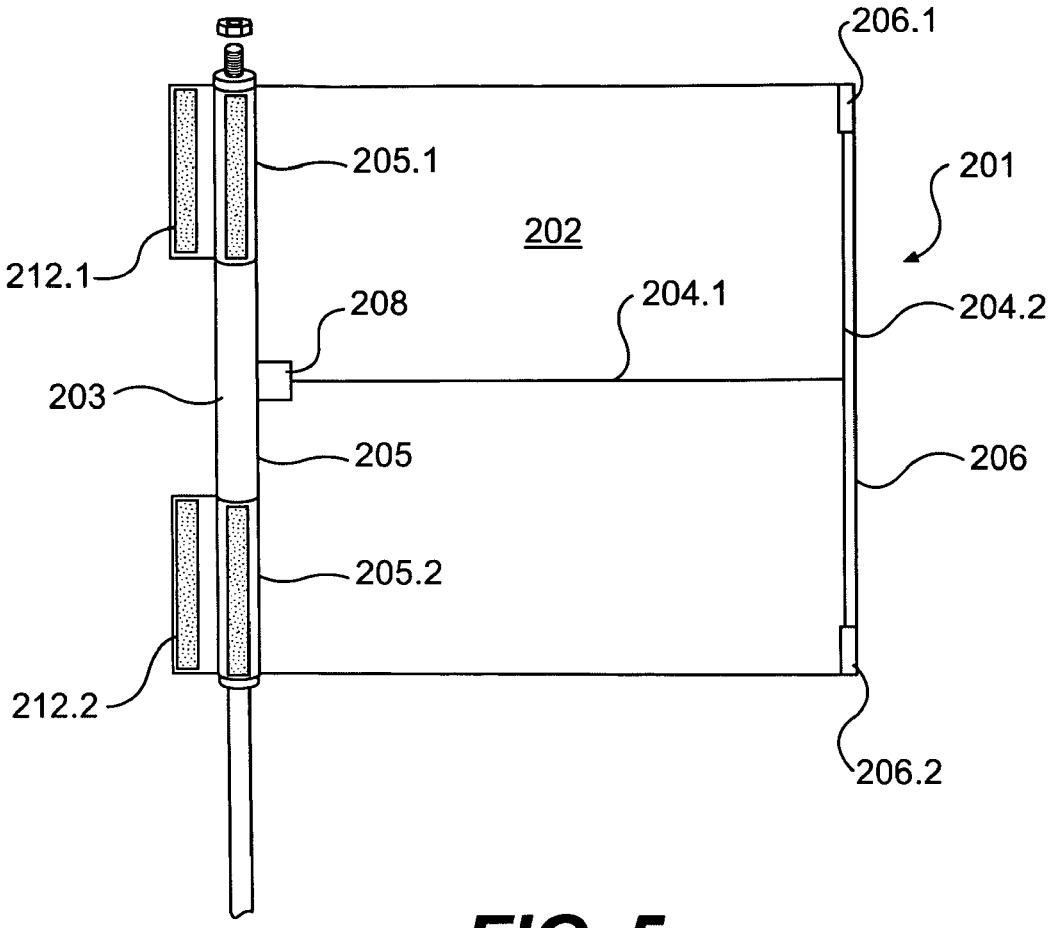
FIG. 5 is side view of a further embodiment of the invention.

With reference to FIG. 5 of the drawings, a further embodiment of a flag in accordance with the invention, is designated generally by the reference numeral 201 and like reference numerals refer to like components.

Flag 201 includes a T-piece distending means in the form of rods 204.1 and 204.2. Rod 204.1 is removably fixed to a sleeve member 203 via a collar or lug 208 such that rod 204.1 is held integral with sleeve member 203, and free ends of rod 204.2 are retained in pockets 206.1 and 206.2 located in the corners of trailing end 206 of membrane 202.

The leading end 205 of membrane 202 is removably attached to sleeve member 203 by means of VELCRO indicated by reference numerals 212.1 and 212.2 provided at an upper end 205.1 and a lower end 205.2, respectively, of membrane 202.

Figure 6:
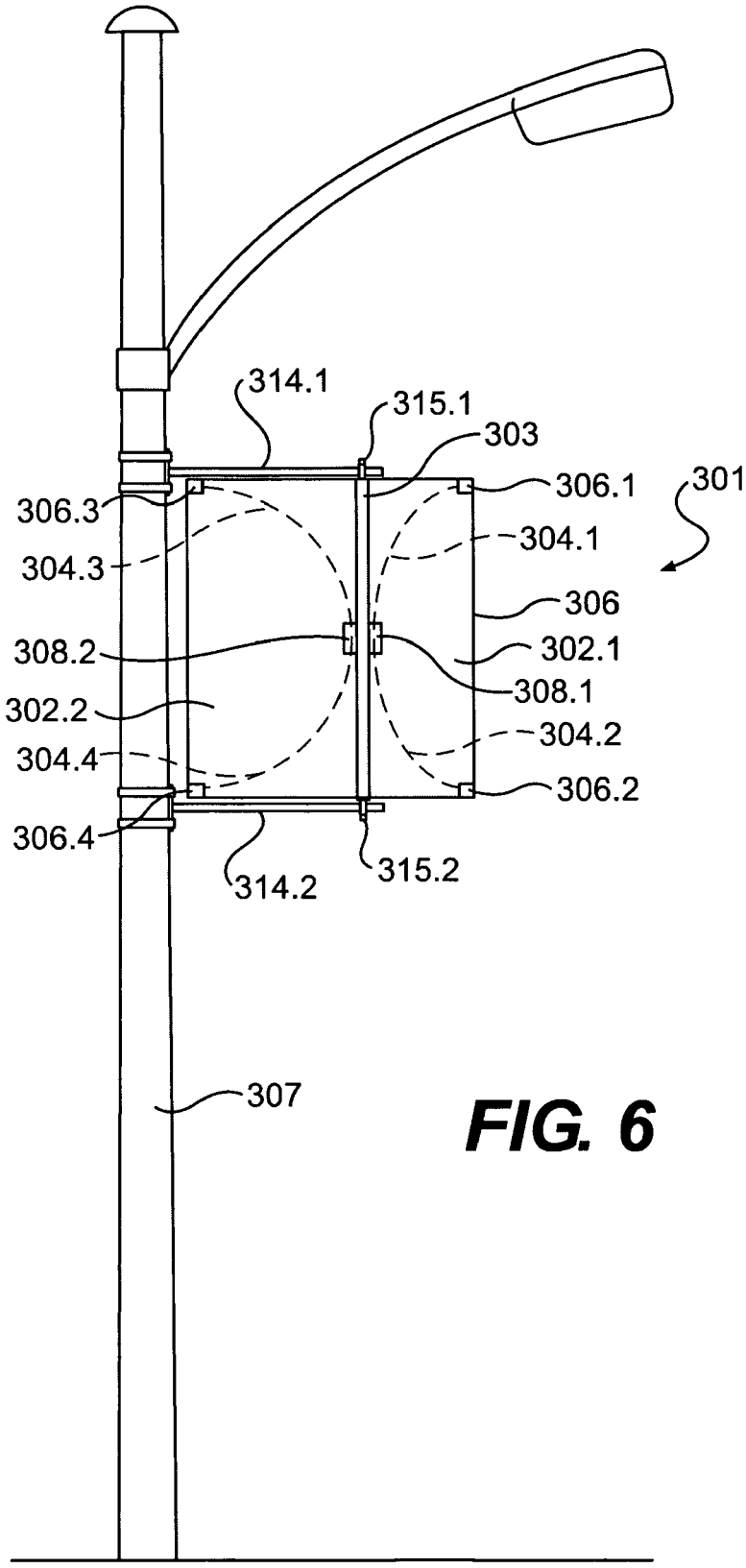
FIG. 6 is a side view of another embodiment of the invention.
Figure 7:
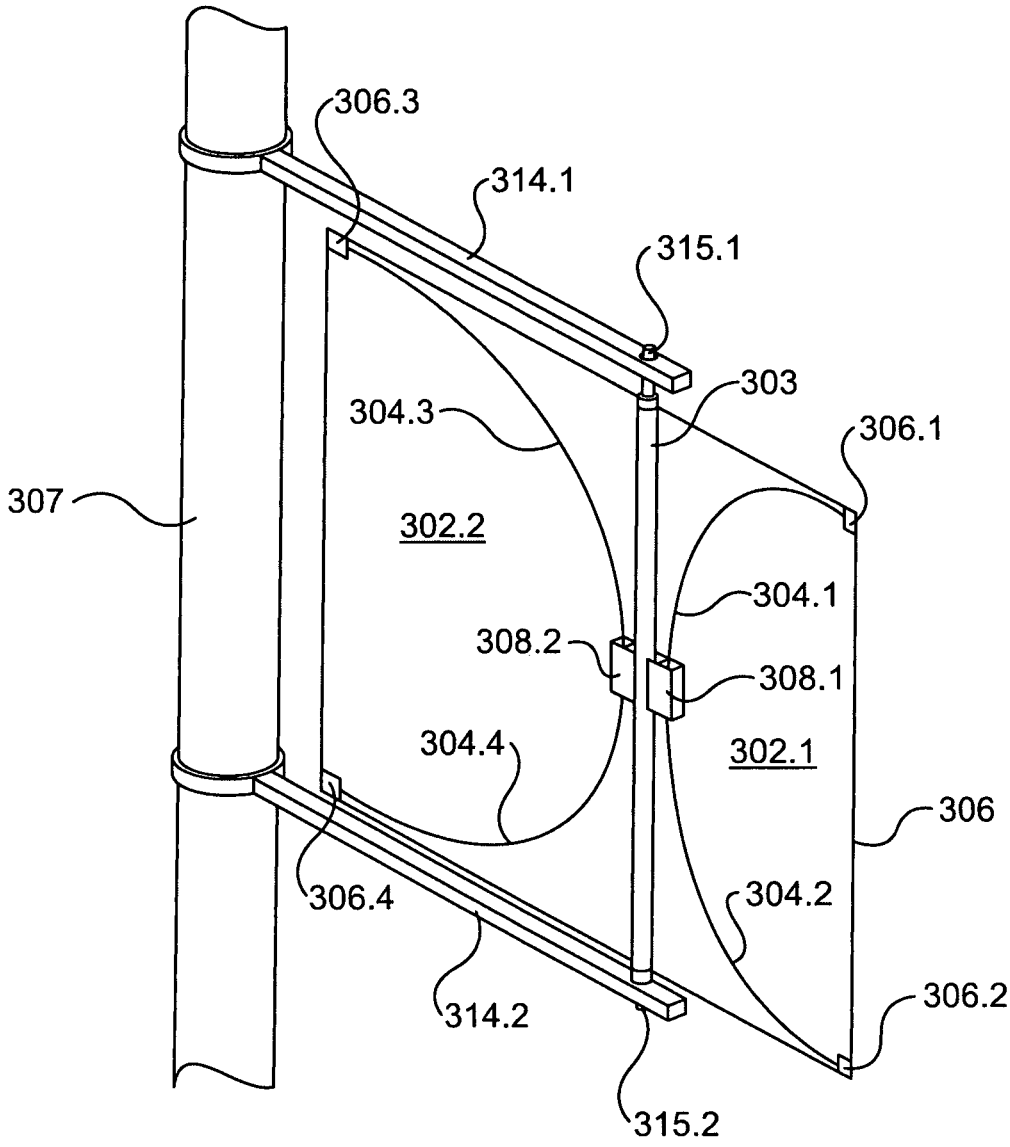
FIG. 7 is an enlarged pictorial view of the rear of the flag depicted in FIG. 6.

With reference to FIGS. 6 and 7, a further embodiment of the invention, in the form of what is colloquially known as a "boulevard banner," is designated generally by the reference numeral 301 and like components, as hereinbefore designated by given reference numerals, are again designated by like reference numerals.

The boulevard banner 301 is shown attached to a light pole 307 which, in this embodiment, serves as a flag staff. Membrane shaft 303 is rotatably mounted, with its axis parallel to and remote from the axis of staff light pole 307, on arms 314.1 and 314.2 extending from pole 307 to which the arms are clamped. Membrane shaft 303 is rotatably mounted on arms 314.1 and 314.2 via pivots 315.1 and 315.2 about which shaft 303 is free to rotate.

Membranes 302.1 and 302.2 are removably attached to shaft 303, in any manner of the kind earlier described herein, on opposite sides of shaft 303. The parameters of membranes are asymmetrical with membrane 302.1, which would face the wind in use, having the lesser width. Membrane 302. 1 is held distended by the fixing ends of rods 304.1 and 304.2 that are frictionally fitted into collar or lug 308.1 mounted on membrane shaft 303 and the free ends of rods 304.1 and 304.2 that are held in pockets 306.1 and 306.2 on trailing end 306. Membrane 302.2 is held distended by the fixing ends of rods 304.3 and 304.4 that are frictionally fitted into collar or lug 308.2 also mounted on membrane shaft 303 and the free ends of rods 304.3 and 304.4 that are held in pockets 306.3 and 306.4.

Both sides of the boulevard banner are assembled and disassembled in a like manner as in the case of the flags described earlier herein.

FIGS. 8 to 11 of the drawings show different ways in which the layouts of the distending means of the invention could be configured.

Figure 8:
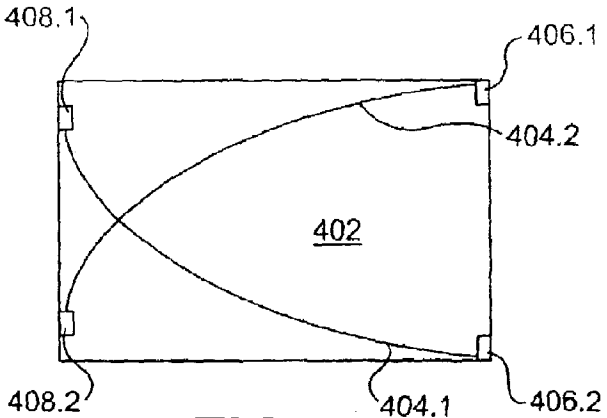

In FIG. 8, rods 404.1 and 404.2 keep membrane 402 distended by their fixing ends being held integral in collars or lugs 408.1 and 408.2 mounted on a shaft or sleeve aligned with a flag staff or pole (not shown in any of FIGS. 8 to 11) as described earlier herein and their free ends being held in pockets 406.1 and 406.2 in membrane 402. This is the preferred configuration when the membrane is used to display information in landscape orientation.

Figure 9:
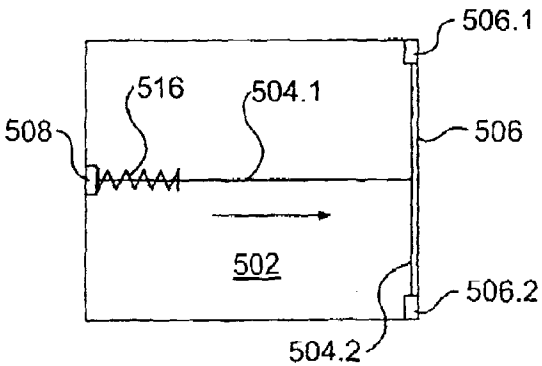

FIG. 9 shows a layout of the distending means similar to that illustrated in FIG. 5. In the layout shown in FIG. 9 the distending means consists of rods 504.1 and 504.2 in a T-shaped formation. The fixing end of rod 504.1 is held firmly in collar or lug 508 and the other end is integral with rod 504.2. The free ends of rod 504.2 are held in pockets 506.1 and 506.2 in membrane 502.

Rod 504.1 is biased, by a well known compression spring device 516 mounted on rod 504.1, from a position away from collar or lug 508 and towards the trailing end 506 of membrane 502 as shown by the arrow in FIG. 9. This spring bias assists in keeping membrane 502 in a distended form.

Figure 10:
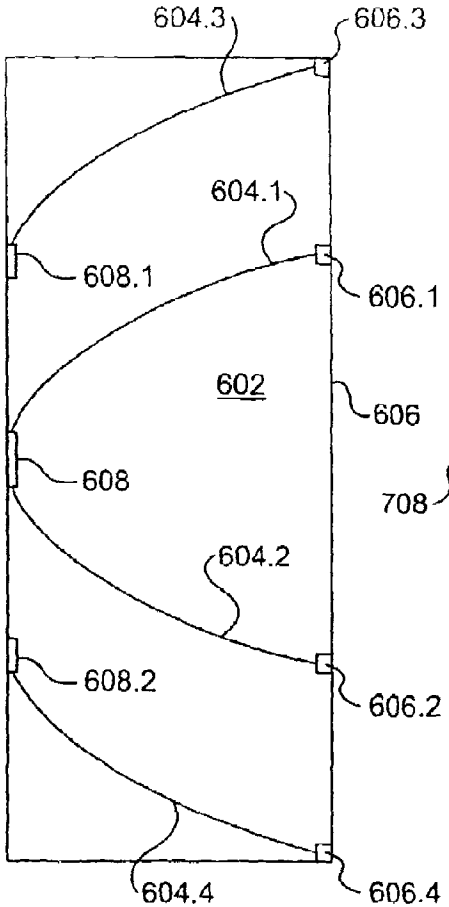

FIG. 10 illustrates a preferred configuration where the flag or banner is of large dimensions and where additional distending means are required to keep the flag or banner distended.

As shown in FIG. 10, the distending means consists of rods 604.1, 604.2, 604.3 and 604.4. The fixing end of rod 604.1 is located in collar 608 mounted on a flag staff or pole and the free end thereof is housed in pocket 606.1 on the trailing end 606 of membrane 602; the fixing end of rod 604.2 is also located in collar or lug 608 and the free end thereof in pocket 606.2; the fixing end of rod 604.3 is located in collar or lug 608.1 and the free end thereof in pocket 606.3; and the fixing end of rod 604.4 is located in collar or lug 608.2 and the free end thereof in pocket 606.4.

Figure 11:
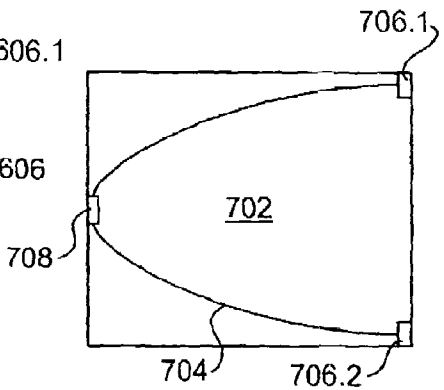
FIGS. 8 to 11 are side views of different layouts of the distending means of the invention.

FIG. 11 illustrates an embodiment of the invention in which rod 704 is in a single, continuous form and is held fixed in position by collar or lug 708 mounted on shaft with the free ends of the rod being housed in pockets 706.1 and 706.2 in membrane 702. Applicant envisages that the flag construction according to the invention will be suitable for use in displaying advertising material.

More importantly, the flag construction according to the invention allows for the interchangeability of flags.

It will be appreciated that the exact shape and configuration of the flag may be greatly variable while still incorporating the essential features of the invention.

Accordingly, the applicant envisages that the flag construction may also be suitable for displaying advertising information whilst also serving as a wind direction indicator.

The invention claimed is:

1. A flag for a flag staff having a longitudinal axis, said flag comprising:

a) a sleeve member including two outer ends and adapted to rotate about an axis of rotation that is congruent with said axis of said flag staff;

b) a flexible membrane including a leading end, a trailing end, and tube means extending along at least a portion of the leading end of the flexible membrane for removably attaching said leading end of said membrane to said sleeve member;

c) removable retention means for holding said sleeve member on its axis of rotation;

d) distending means for holding said membrane distended normal to said sleeve member and across the plane of the membrane by applying pressure from within said membrane;

e) said distending means including resilient rod means having two outer distal ends that extend to the trailing end of said flexible membrane;

f) pocket means located at the trailing end of said flexible membrane for receiving the outer distal ends of the resilient rod means; and g) collar means connected to the sleeve member at a location intermediate the outer ends of the sleeve member for fixing said resilient rod means in place on the sleeve member.

2. A flag as defined in claim 1 wherein said tube means is formed by a seam provided along a least a portion of the leading end of the membrane with said sleeve member being disposed in said tube means.

3. A flag as defined in claim 1 wherein said flexible membrane is selected from the group of a textile material, a fabric material, and a plastic material.

4. A flag as defined in claim 1 wherein said distending means is integral with said sleeve member.

5. A flag as defined in claim 1 wherein said distending means is removably fixed to said sleeve member.

6. A flag as defined in claim 1 wherein said tube means includes hook and loop fasteners.

7. A flag as defined in claim 6 wherein said tube means extends for a distance between said collar means and said two outer ends to form upper and lower tube sections.

8. A flag for a flag staff having a longitudinal axis, said flag comprising:

a) a sleeve member including two outer ends and adapted to rotate about an axis of rotation that is congruent with said axis of said flag staff;

b) a flexible membrane having a structural configuration of an envelope with a leading end, a trailing end, and means extending along the leading end of the flexible membrane for removably attaching said leading end of said membrane to said sleeve member;

c) removable retention means for holding said sleeve member on its axis of rotation;

d) distending means for holding said membrane distended normal to said sleeve member and across the plane of the membrane by applying pressure from within said membrane;

c) said distending means including resilient rod means having two outer distal end sections that extend to the trailing end of said flexible membrane envelope for applying pressure from within said membrane in two outward directions parallel to said axis of rotation of said sleeve member; and d) collar means connected to the sleeve member at a location intermediate the outer ends of the sleeve member for holding said resilient rod means in place on the sleeve member.

9. A flag for a flag staff having a longitudinal axis, said flag comprising:

a) a pair of parallel arms extending outwardly from said flag staff and a shaft member including two outer ends and rotatably mounted between said parallel arms to rotate about an axis of rotation that is parallel to and remote from said axis of said flag staff;

b) flexible membranes each including a leading end, a trailing end, and means extending along at least a portion of the leading end of each flexible membrane for removably attaching said leading end of said membranes to said shaft member;

c) removable retention means for holding said shaft member on its axis of rotation between said parallel arms to allow the shaft member to freely rotate;

d) distending means for holding each said membrane distended normal to opposing sides of said shaft member and across the plane of each said membrane by applying pressure from within each said membrane;

e) said distending means including resilient rod means having two outer distal ends that extend from said opposing sides of said shaft member to the trailing end of each said flexible membrane;

f) pocket means located at the trailing end of each said flexible membrane for receiving the respective outer distal ends of each said resilient rod means; and g) collar means connected to said opposing sides of said shaft member at a location intermediate the outer ends of the shaft member for fixing said resilient rod means in place on the shaft member.

* * * * *